US005308563A

United States Patent [19]

Hodan et al.

[11] Patent Number: 5,308,563

[45] Date of Patent: May 3, 1994

[54] PROCESS FOR PRODUCING ANTISTATIC YARNS

[75] Inventors: John A. Hodan, Arden; Otto M. Ilg, Asheville, both of N.C.; Melvin R. Thompson, Anderson, S.C.; Donald B. Thompson, Memphis, Tenn.

[73] Assignee: BASF Corporation, Parsippany, N.J.

[21] Appl. No.: 937,568

[22] Filed: Aug. 31, 1992

[51] Int. Cl.[5] ..... D01D 5/08; D02G 1/10; D02G 3/12

[52] U.S. Cl. ..... 264/103; 264/105; 264/129; 264/136; 264/168; 264/211.12; 427/122; 427/393.1; 427/427

[58] Field of Search ..... 264/103, 104, 105, 129, 264/136, 168, 210.8, 211.12; 427/122, 393.1, 421, 427

[56] References Cited

U.S. PATENT DOCUMENTS

| | | | |
|---|---|---|---|
| 3,423,809 | 1/1969 | Schmitt | 264/103 X |
| 3,823,035 | 7/1974 | Sanders | 428/368 |
| 3,955,952 | 5/1976 | Drummond | 65/3.4 |
| 4,085,182 | 4/1978 | Kato | 264/171 |
| 4,153,660 | 5/1979 | Reese | 264/103 |
| 4,255,487 | 3/1981 | Sanders | 428/368 |
| 4,545,835 | 10/1985 | Gusack | 156/180 |
| 4,612,150 | 9/1986 | De Howitt | 264/103 |
| 4,704,311 | 11/1987 | Pickering et al. | 427/393.1 |
| 4,997,712 | 3/1991 | Lin | 428/372 |

FOREIGN PATENT DOCUMENTS

| | | |
|---|---|---|
| 2466517 | 4/1981 | France . |

*Primary Examiner*—Leo B. Tentoni
*Attorney, Agent, or Firm*—Karen M. Dellerman

[57] ABSTRACT

A process for producing a conductive supported yarn includes melt spinning non-conductive nylon filaments into a first set of filaments, separating at least one of the filaments from the freshly spun first set into a second set of filaments, providing the second set of filaments to a suffusion coating process so that the suffusion coated second set has a resistivity of between about $10^6$ and about $10^9$ Ω/cm, and then recombining the first set and the second set to form a supported yarn.

20 Claims, 4 Drawing Sheets

PROCESS FOR PRODUCING ANTISTATIC YARNS

FIELD OF THE INVENTION

The present invention relates generally to a process for producing antistatic yarns. More particularly, the present invention relates to a one-step spin-coat process to produce antistatic yarn from melt spinnable synthetic polymers.

BACKGROUND OF THE INVENTION

Static electricity buildup in carpets and textiles made of synthetic fibrous polymers has long been an inconvenience. With today's widespread use of computers, it has become a more serious problem. Static electricity buildup followed by discharge can damage computer circuits and destroy information stored in computer memory. By adding a conductive fiber to carpet yarn, the buildup of static electricity is overcome. The problem then becomes producing the conductive fiber.

Two of the most widely produced conductive filaments are coated filaments and bicomponent filaments, with coated fibers generally having the greater conductivity. There have been many approaches of coating filaments to make them conductive, including suffusion coating.

Exemplary of patents describing the production of conductive synthetic filaments is U.S. Pat. No. 4,085,182 to Kato, which describes a process for making sheath/core filaments. The Kato filament has a conductive core.

Sometimes it is desirable to ply one or more conductive filaments with non-conductive filaments to provide support to the conductive filament for later end uses. Such a plied yarn is known as supported yarn. Supported conductive yarn is useful, for example, when inserting the conductive filament in carpet yarn.

Co-extrusion of conductive filaments with non-conductive filaments appears to be shown in French Pat. Publication No. 2466517 (FIGS. 1-6). One advantage of using supported conductive yarn for end uses is that the supported yarn can be conventionally dyed, masking the dark color of conductive filaments made conductive by use of dark materials like carbon. Since the conductive filament is an integral part of the yarn bundle, another advantage of supported conductive yarn is improved downstream performance during knitting, weaving or insertion into carpet yarn.

Insertion of conductive filaments into non-conductive yarn is known. Previously spun and wound-up conductive filaments may be combined with one or more freshly spun, non-conductive filaments to make bulked continuous filament yarn which is antistatic. Exemplary are U.S. Pat. No. 4,612,150 to De Howitt and U.S. Pat. No. 4,997,712 to Lin. Both of these patents described processes for combining previously spun conductive filaments with freshly spun non-conductive filaments followed by co-drawing and co-bulking. The insertion of wound-up filaments into freshly spun filaments requires extra bobbins and labor when making conductive yarn.

Individual previously spun and wound up filament sets may be combined immediately after the carbon suffusion of one set. See, for example, U.S. Pat. No. 4,545,835 to Gusack et al.

Making supported conductive yarns by insertion of a conductive feed yarn according to known methods is fairly burdensome and labor intensive, in that separate processes are required. One process is needed for making the conductive filament for insertion and another process for inserting the wound-up conductive yarn to a spinning process. In addition, known methods for insuring interweaving of the conductive filament are not always as efficient as desired.

It is known to differentially treat separate bundles of freshly spun yarn followed by recombination of the two separately treated bundles. For example, U.S. Pat. No. 3,423,809 to Schmitt describes a process for combining two separately spun and treated filament bundles which are annealed under separate conditions and then recombined to produce a non-conductive yarn having differential shrinkage.

U.S. Pat. No. 3,955,952 to Drummond describes a method for forming a slubby glass fiber by subjecting separate groups of freshly spun glass fibers to differential velocity prior to combination.

U.S. Pat. No. 4,153,660 to Reese describes a process for producing differential shrinkage in yarns when heated. The differential shrinkage is due to the application of different finishes to two different freshly spun filament bundles, which are then combined.

Yet, there is no known process for making a supported conductive yarn in a self-contained process. Such a one-step process would provide several advantages over the state of the art. Some of these advantages are the elimination of the production, packaging, and storage of feed yarn packages; improved coating performance; elimination of other sources for feed yarn; deniers and filament counts can be easily changed; improved control of conductive or support yarn properties; and reduction in the manpower needed to prepare an antistatic yarn. Another aspect of such a process includes presentation to the suffusion coater of a yarn having constant tension. This allows higher speeds than available with high and erratic backwinding tensions.

SUMMARY OF THE INVENTION

Accordingly, a first embodiment of the present invention relates to a process for producing a conductive supported yarn including the steps of melt spinning non-conductive nylon filaments to form a first set of filaments, separating at least one of the filaments from the freshly spun first set into a second set of filaments, providing the second set of filaments to a suffusion coating process so that after said providing, the suffusion coated second set has a resistivity of between about $10^6$ and about $10^9$ $\Omega$/cm, and recombining the first set and the second set to form a supported yarn.

A second embodiment of the invention relates to a process for preparing multifilamentary conductive yarn.

A third embodiment of the invention relates to a process for preparing conductive monofilament.

It is an object of the present invention to provide an improved process for preparing conductive yarn.

After reading the following description, related objects and advantages of the present invention will be apparent to those ordinarily skilled in the art to which the invention pertains.

DETAILED DESCRIPTION OF THE PREFERRED EMBODIMENTS

To promote an understanding of the principles of the present invention, descriptions of specific embodiments of the invention follow and specific language describes the same. It will nevertheless be understood that no limitation of the scope of the invention is thereby intended, and that such alterations and further modifications, and such further applications of the principles of the invention as discussed are contemplated as would normally occur to one ordinarily skilled in the art to which the invention pertains.

One embodiment of the process of the present invention separates at least one filament from a group of freshly spun filaments, coats the separated filament with an aggressive acid slurry and then recombines it with the uncoated filaments to form, in a single step, a supported antistatic yarn. Alternatively, in another embodiment, all filaments are coated to produce coated antistatic yarn in a single integrated process. A single filament or group of filaments are melt spun from a conventional melt spinning system. The fibers may be spun at conventional speeds and then drawn or spun at high speeds (greater than 3500 mpm) to produce a fully oriented fiber for coating.

The processes of the present invention are suitable for use with fiber-forming synthetic linear high molecular weight polymers, such as, without limitation, nylon 6 (poly-ε-caprolactam) or nylon 6,6 (polyhexamethylene adipimide). These polyamides may be modified by the usual additives or comonomers. The processes have been found to be particularly suitable for use with nylon 6 having a relative viscosity (measured on a solution of 1 gram of poly-ε-caprolactam in 100 mls of 96% sulfuric acid at 25° C.) of between 2.3 and 3.5, and preferably of between 2.4 and 3.2. In addition, the processes can accommodate multi-component fibers, directly melt spun for coating or draw-coating as long as the surface polymer is partially soluble in or softened by the solvent in the suffusion mix.

In the processes, filaments of fiber-forming polymers are melt spun directly, without winding, to a suffision coating apparatus. The polymers are first melt spun at temperatures of from 260° to 295° C., and preferably from 265° to 285° C. It is advantageous to spin filaments having a total final denier of from 3 to 100 denier and preferably from 10 to 75 denier, the final denier of the individual filaments being from 3 to 30 denier. The molten filaments are normally cooled by blowing air in the cooling cabinets.

Figure 1:
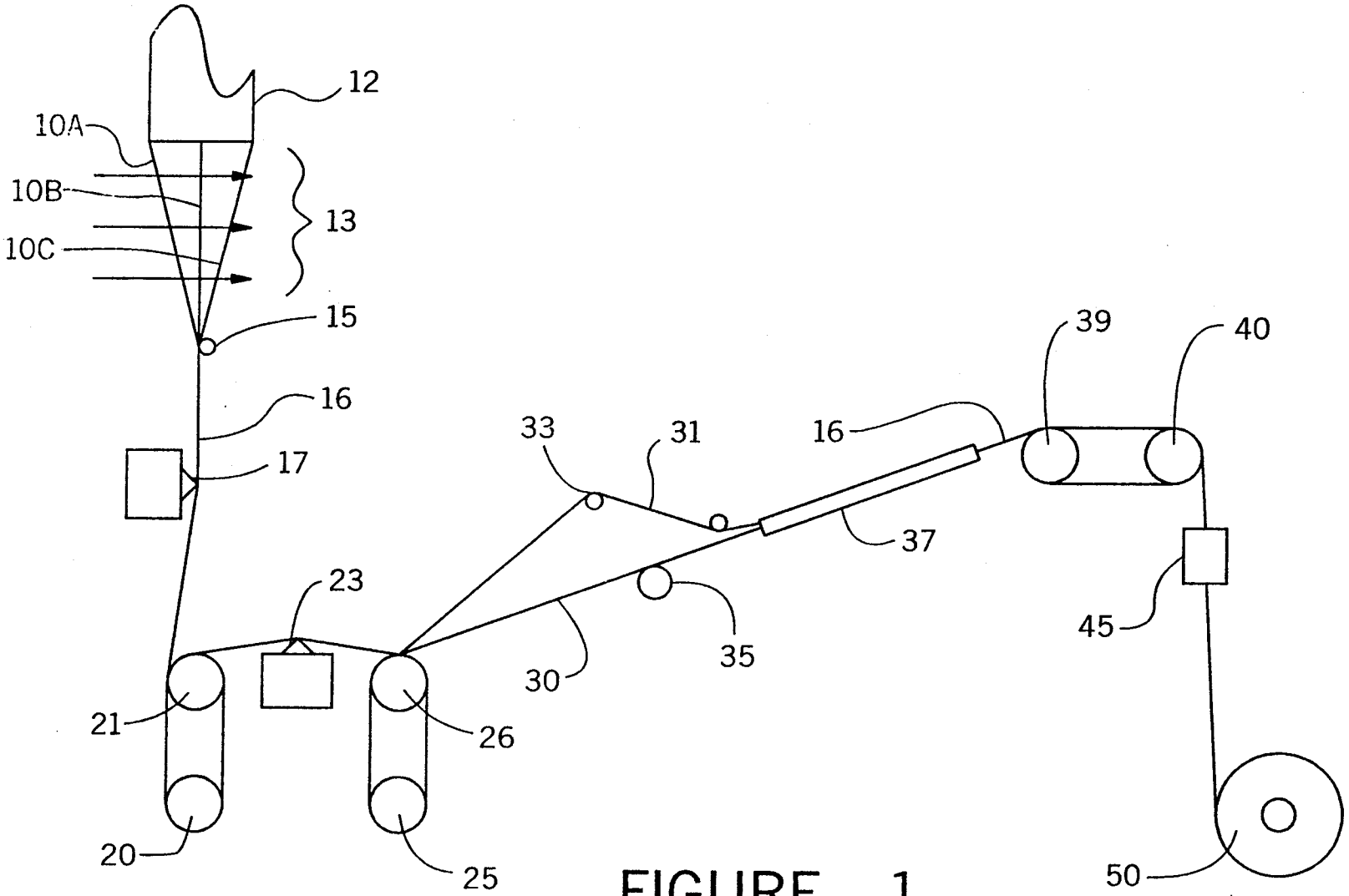
FIG. 1 is a thread flow diagram of a process according to the present invention.

Following melt spinning and quenching, the filaments are cooled sufficiently to prevent adhesion of the individual filaments to each other. Then the filaments are subjected to several other steps which may occur in several orders. First is a spin-draw-coat process shown in FIG. 1. FIG. 1 will be explained in more detail below. In this embodiment, following the application of finish, drawing, if desired, may be carried out in one or more stages using godets, particularly pairs of godets. The amount of finish should be adjusted to prevent interference with the effectiveness of the suffusion coating. One useful level of finish application is about 0.5%, more preferably 0.3%, by fiber weight. Aqueous finishes should be avoided because such finishes may cause spot crystallization which effects drawing performance. The draw ratio is adjusted by controlling the relative speeds of the drawing elements. Preferably, where a drawn supported filament is desired, the draw ratio is preferably from 1:1 to 1:5, more preferably 1:2.5 to 1:4. Yet, it is contemplated that undrawn supported filaments may be made in a single step by setting the draw ratio to 1.0 or by bypassing the second duo or pair of draw rolls.

Very suitable for maintaining an adequately constant temperature are jacketed sealed godets filled with a vapor. By this means it is possible to keep the temperature constant over the whole surface of the godet. Temperature control is affected by non-touching thermoelements inside the rotating godet. It is important to maintain the correct temperatures in the stretching elements. The first of such elements or, in the case of more than two stretching elements, the first two stretching elements should have a controlled surface temperature such as may be accomplished with fluorocarbon filled rolls. The following stretching element should also have a controlled surface temperature such as may be accomplished with water filled rolls. The draw ratio should be adjusted to yield drawn filaments having an extensibility of from 10 to 90%, and preferably of from 20 to 60%.

Prior to or after drawing, but prior to coating, the fibers can be subjected to non-symmetrical stress by applying cold liquid or an edge/knife crimping device so that desirable crimp or curl is developed in the finished product. It should be noted that some crimp may be inherent in filaments made by this process since finish application can be asymmetrical. For certain applications, crimp is beneficial because, for example, it makes the antistatic yarn interlock with carpet yarn upon insertion.

Following drawing, at least one filament is separated from the bundle and routed to a coating apparatus where suffusion coating takes place. The application of coating may be accomplished by means of a kiss roll, static slit tube, wetted felt, sprayer or any other means which allows a moving filament to be coated. The process for the suffusion coating step may be as described in U.S. Pat. No. 3,823,035 and U.S. Pat. No. 4,255,487, both to Sanders, and U.S. Pat. No. 4,704,311 to Pickering et al., all incorporated herein by reference for teaching how to make carbon suffused fiber. U.S. Pat. No. 3,823,035 describes, for example, how to make a carbon suffused fiber where the electrically conductive particles are suffused in an annular region located at the periphery of the filament. The separated filament should be presented to the coating apparatus under constant tension which can be maintained by several methods including, for example, godets before and after the coater, tensioning discs, tensioning devices with magnetic breaking, or godets with idler rolls or discs. Although tension depends on the coating apparatus, denier, coating viscosity and coating percent add on, 0.3 to 2 gm/denier is a general range. In any event, the tension should be sufficiently low to prevent breaks at the coater.

In the suffusion processes, drying temperature is typically 150° to 200° C. using an 8 foot long drying tube. Although it is preferable, it is not essential that the conductive component of the suffused fiber is carbon. In fact, other materials, such as tin oxide, are known for producing a conductive filament through suffusion. Preferably, however, the conductive component is carbon black present in a sheath containing carbon at 40 to 70% by weight of solids in the sheath. The sheath preferably occupies 5 to 30% of the fiber cross-section. The electrical resistivity of the conductive filament should be in the range of about $10^6$ to $10^9$ ohms per centimeter per filament. It should be noted that, in general, resistivity increases with increasing draw ratio (or spinning speed for partially oriented (POY) and fully oriented (FOY) yarns) due to changes in the structure of the carbon black network.

It is preferable that the coating process produces a nominal 5 micron thick conductive surface on the filament. This conductive surface may be accomplished in a number of ways, including by using a slot coater, a roll coater, or by submerging a guide in a mix bath and running the filament to be suffused underneath the guide. The suffusion mix generally consists of carbon black dispersed in a formic/acetic acid, nylon solution. Bonding of the layer to the filament surface occurs via solvent initiated suffusion or a solvent bonding process. Solidification of the surface, which is comprised of a solid mixture of nylon and carbon black, occurs with evaporation of the mixed acid solvent in the dryer. Where slot roll or groove coaters are used, it is advantageous to periodically clean the coater with hydrofluoric acid to prevent build-up and resultant overthrown ends and friction roll wraps.

Other important factors in coating success include the angle at which the filaments contact the coating applicator. Contact angle is important in overcoming problems with cavitation that may result from high speeds. Preferably, this angle is 45°–90° to permit longer contact with the coating apparatus. Also, under higher tensions, the solvent eats through the fiber more quickly than at lower tensions. The ideal tension depends on the fiber denier and type, etc.

One advantageous feature of the present invention is that the freshly drawn filaments are at an elevated temperature. This allows a reduced acid content in the coating mix and, possibly, a more volatile mix which would give more efficient drying. The length of time required for effective suffusion is related to the critical dissolution time. Critical dissolution time is the time required for a yarn to break when subjected to given solvent and under a tension of 1 gram/denier at 25° C. Filament stress (tension) also bears a direct relation to critical dissolution time. Therefore, since the tension control of this one-step process exceeds the tension control possible with feed bobbins, the invention produces a less sensitive and more easily controlled process. For example, there are fewer breaks due to tension variations.

Following the suffusion coating of one or more of the filaments, the coated filaments and support filaments are routed through a dryer such as, for example, a split clam shell type heater which volatilizes the solvent in the suffusion coating and enhances the development of crimp in both the conductive and support filaments. The filaments then re-join the support filaments for further processing. The filaments are then passed over passive winding godets and through an interlacer where they are combined according to conventional interlacing procedures. Useful interlacers are any one of many known in the art. Also, as an alternative, false twist may be put in the yarn.

Finally, the carbon suffused filaments and the support filaments are wound on a bobbin. These filaments may then be unwound when it is desired to process the yarn into a final product, such as a carpet or textile yarn.

While the preceding spin-draw-coat process is preferred, the process steps may, as noted, take place in other orders. However, although the order of steps varies, the temperatures, tensions, finishes, etc., are the same regardless of order. A second order is a spin-coat-draw process as shown in more detail in FIG. 2 and explained more fully below. Also, drawing may be bypassed altogether.

The present invention is also applicable to the production of monofilament fiber, multi-filament fiber or tow, and if combined with a high speed cutter, conductive/coated staple fiber may be produced. Any conceivable cross-sections which are commonly made in melt spinning can be processed for special effects like retention of more conductive mix, such as in the apexes of a trilobal fiber.

To assist in understanding the spin-draw-coat process of the present invention, reference will now be made to FIG. 1. This method is preferred because the yarn is drawn prior to coating, allowing precise control of yarn properties. Failure to adequately quench may result in unsatisfactory coating performance. FIG. 1 is a thread flow diagram of a process according to the present invention. Three filaments 10*a*, 10*b*, and 10*c* are shown being extruded from spinneret 12. Of course, more than three filaments may be extruded at one time, but for the sake of clarity in the figure, only three filaments are shown. After extrusion, filaments 10 are subjected to quench air in region 13 which cools the filaments to at least below the stick point for the fiber-forming thermoplastic material being extruded. The three filaments are then combined into a multifilamentary yarn at guide 15. The multifilamentary yarn 16 passes by finish applicator 17. Suitable finishes include but are not limited to blends of aliphatic esters, ethoxylated alcohols and inorganic and organic soaps with and without sulfation.

Following the application of the finish, yarn 16 passes over the first pair of godets 20 and 21 running at the same speed. Following the first pair of godets, multifilamentary yarn 16 may pass over optional edge crimper 23 and then (if drawing is desired) pass to the second pair of draw godets 25 and 26. Godets 25 and 26 operate at the same speed relative to each other, but about three times faster than godets 20 and 21. If drawing is not desired, than godets 25 and 26 can be eliminated.

Following the second pair of godets, one or more filaments 30 (1 is shown) is separated from multifilamentary yarn 16, which is now labeled 31 to signify that it is a smaller bundle than multifilamentary yarn 16. Multifilamentary yarn 31 is directed over guide 33 and away from the path of filament 30. While still warm from the extrusion process, filament 30 is subjected to suffusion coating at coating apparatus 35. Following coating, multifilamentary yarn 31 and suffusion coated filament 30 are recombined into multifilamentary yarn 16, after both pass through dryer 37. The recombined filaments pass over winding godets 39 and 40 operating at the same speed. Subsequent to winding godets 39 and 40, multifilamentary yarn 16 passes through an interlacer 45 where the filaments are subjected to a fluid jet which entangles the yarns to form a coherent bundle which is then wound on winder 50.

Figure 2:
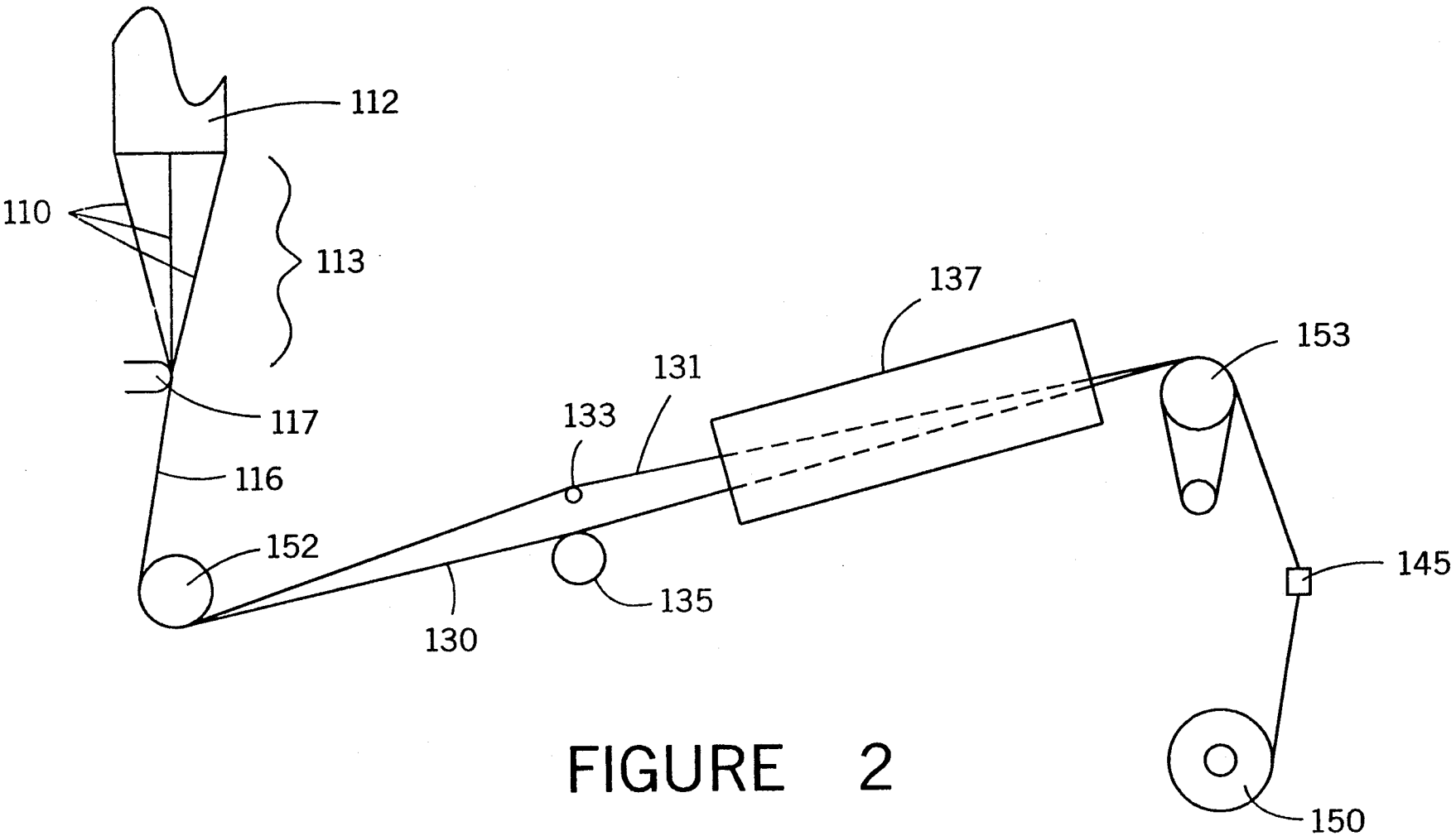
FIG. 2 is a thread flow diagram of an alternative process according to the present invention.

Turning to FIG. 2, filaments 110 are spun from spinneret 112 and quenched in zone 113. Finish applicator 117 applies finish to multi-filamentary yarn 116. Support yarn 131 is separated from filament 130 and passes over guide 133. Filament 130 is suffusion coated at coater 135. Both sets of filaments 131 and 130 pass through heater 137, are rejoined, optionally interlaced at 145, and taken up on winder 150. The process variables, such as speed, temperature, etc., are as described above.

In this variation of the invention, however, the filaments are coated during the drawing process. Godets 152 and 153 operate at a speed differential (godet 153 is faster) to cause drawing.

It should be noted that it is possible to coat then draw but this is typically less satisfactory because of the effect drawing has on the conductivity of the coating.

Figure 3:
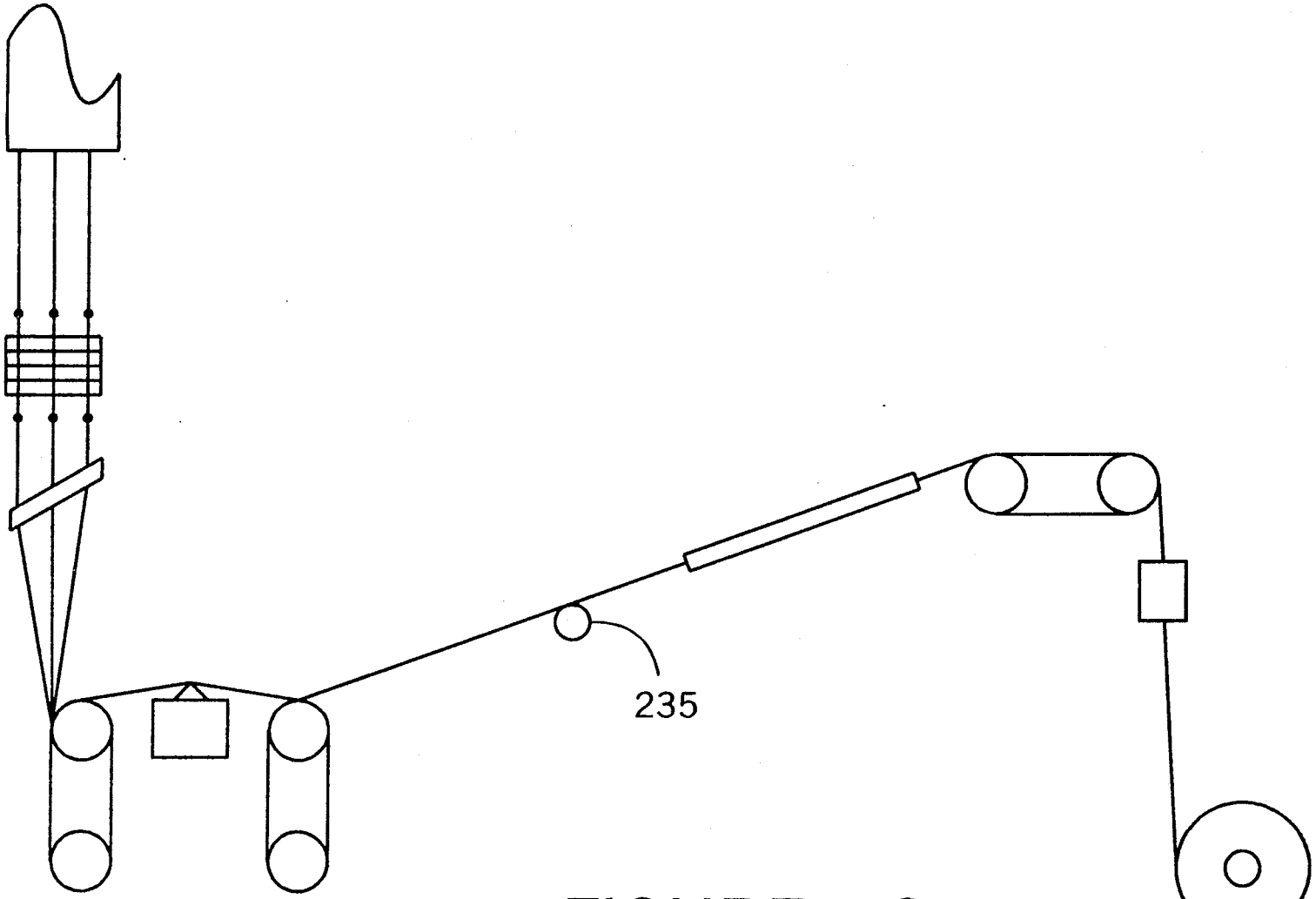
FIG. 3 is a thread flow diagram of a second embodiment of a process according to the present invention.

The supported yarns made by this invention can be used widely as materials for antistatic fibrous products, such as woven, knitted and nonwoven fabrics and tufted cloth, especially in carpets. The composite filaments provided by this invention can be subjected to various ordinary processing steps, such as crimping, scouring or bleaching. In the second embodiment of the present invention, multi-filamentary, conductive yarn is prepared substantially as described for the first embodiment. However, no portion of filaments is separately fed to a suffusion coating means. Instead, each filament is fed to the suffusion coating applicator, as shown in FIG. 3. The coating applicator should be such that each filament is uniformly coated. One suitable device is described in U.S. Pat. No. 4,704,311, incorporated herein by reference. Each filament is subjected to suffusion in one of two ways. As shown in FIG. 3, the filaments are not combined after quenching, and pass separated to coater 235.

Figure 4:
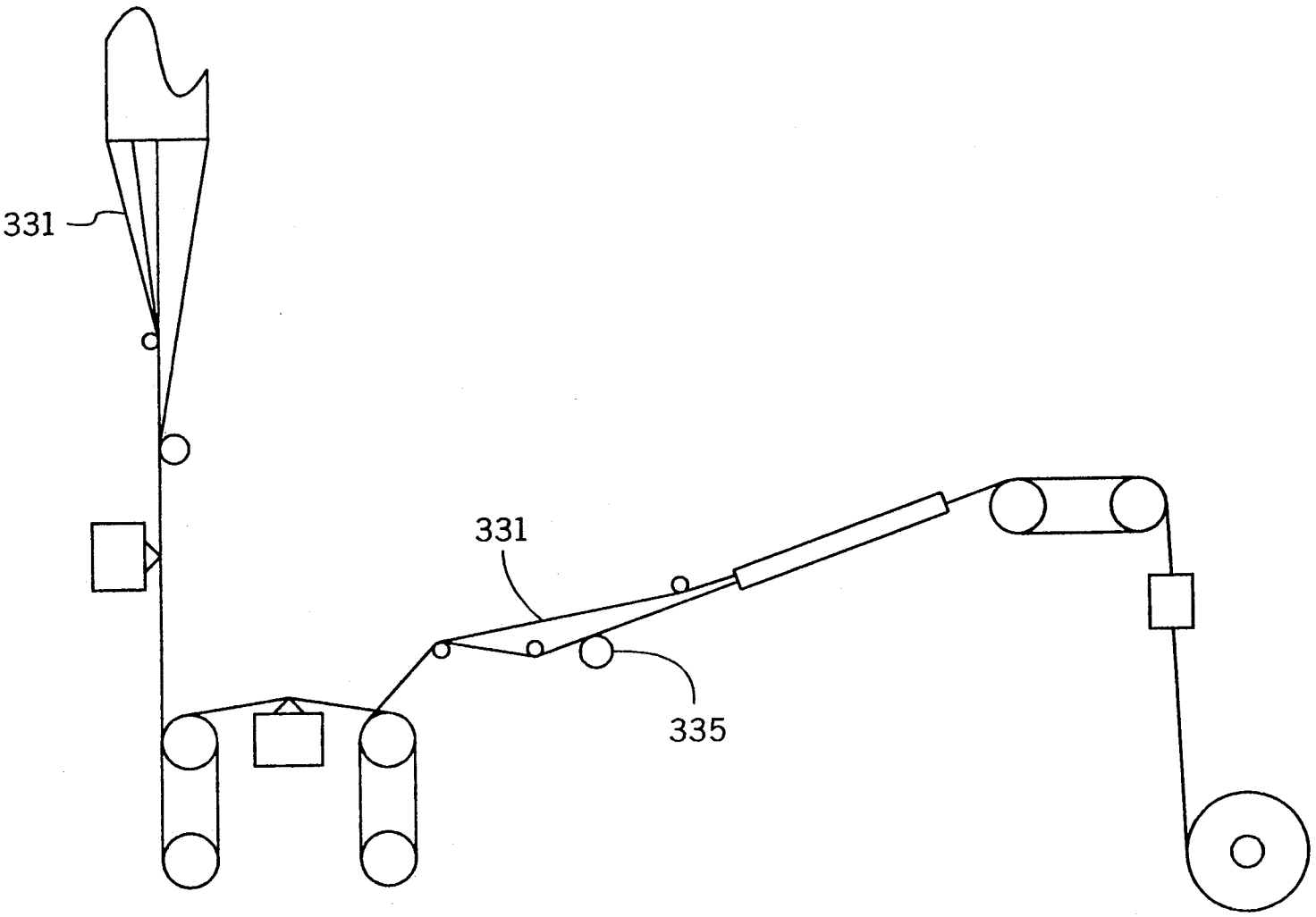
FIG. 4 is a thread flow diagram of an alternate process of the first embodiment according to the present invention.

A variation of the first embodiment is shown in FIG. 4. Support filaments 331 are separated from the filament to be coated before drawing, bypassing coater 335 as shown. In other ways, the process is the same as described in connection with FIG. 1.

Where monofilament conductive yarn is made by the process of the present invention, only a single filament is extruded and passes through the steps shown in FIG. 1, except that a partial bundle 31 is not present.

Also, it should be understood that various combinations of conductive and non-conductive filaments may be made by the present invention. Any combination from a single filament separated and coated to all filaments separated and coated is within the scope contemplated.

The invention will be described by reference to the following detailed example. The Example is set forth by way of illustration, and is not intended to limit the scope of the invention. In the example, all parts are part by weight unless otherwise specified.

EXAMPLE

Nylon 6 with a relative viscosity of 2.7 is measured as 1% dissolved in 96% $H_2SO_4$ spun at 265° C. using a spinneret having 3 round holes. The polymer throughput is 4.5 grams per minute. The fibers are separated into a monofilament threadline and a two-filament threadline. Finish is applied to both threadlines using a grooved ceramic applicator. The two threadlines then make a ½ wrap around the spinning godet, which is rotating at 416 mpm. The conductive coating is applied to the monofilament using a grooved roller applicator rotating at 33 rpm. The two support fibers are routed away from the applicator by a ceramic guide. Both the support fibers and the coated monofilament are then routed through the heater channel which has an inside temperature of 185° C. The two threadlines are combined on the heater exit godet. Three wraps are made around the godet at a speed of 1175 mpm. The combined threadline is then interlaced using an air interlacer. The supported antistat is wound onto a bobbin at 1180 mpm. This is substantially as shown on FIG. 2.

The Example above results in a 34/3 (denier/filament count) supported antistat having a resistivity of $10^6$–$10^7$ Ω/cm, a breaking load of 67.4 gms and elongation of 100%.

What is claimed is:

1. A process for producing a conductive supported yarn comprising:
   melt spinning non-conductive nylon filaments to form a first set of filaments;
   separating at least one of the filaments from the freshly spun first set into a second set of filaments;
   providing the second set of filaments to a suffusion coating process wherein conductive material is suffused into the second set so that after said providing, the suffusion coated second set has a resistivity of between about $10^6$ and about $10^9$ Ω/cm; and
   recombining the first set and the second set to form a conductive supported yarn.

2. The process of claim 1 where the conductive material is carbon black.

3. A process for producing a conductive supported yarn comprising:
   melt spinning non-conductive nylon filaments to form a first set of filaments;
   separating at least one of the filaments from the freshly spun first set into a second set of filaments;
   providing the second set of filaments to a suffusion coating process wherein conductive material is suffused into the second set so that after said providing, the suffusion coated second set has a resistivity of between about $10^6$ and about $10^9$ Ω/cm;
   recombining the first set and the second set to form a conductive supported yarn; and
   subjecting both sets to a source of latent non-symmetrical stress prior to said providing.

4. The process of claim 3 wherein the source is a knife edge.

5. The process of claim 1 and further comprising drawing the filaments prior to said separating.

6. The process of claim 1 wherein said providing is of the second set having residual heat from said melt spinning.

7. A process for preparing an electrically conductive fiber comprising a filamentary polymer substrate having finely divided, electrically conductive particles uniformly suffused in an annular region located at the periphery of the filament and extending the entire length thereof comprising;
   melt-spinning a filament of a fiber forming polymer directly without winding to a suffusion coating apparatus;
   continuously suffusing electrically conductive particles uniformly in an annular region at the periphery of the filament such that after said suffusing the filament is electrically conducting; and
   winding the resulting suffused filament.

8. The process of claim 7 wherein the conductive particles are carbon black.

9. A process for preparing an electrically conductive fiber comprising a filamentary polymer substrate having finely divided, electrically conductive particles uniformly suffused in an annular region located at the periphery of the filament and extending the entire length thereof comprising:

melt-spinning a filament of a fiber forming polymer directly without winding to a suffusion coating apparatus;

continuously suffusing electrically conductive particles uniformly annular region at the periphery of the filament such that after said suffusing the filament is electrically conducting;

winding the resulting suffused filament; and subjecting said filament to a source of latent non-symmetrical stress prior to said suffusing.

10. The process of claim 9 wherein the source is a knife edge.

11. The process of claim 7 further comprising drawing the filament prior to said suffusing.

12. The process of claim 7 wherein the filament has residual heat from said melt spinning during said suffusing.

13. A process for preparing multifilament conductive yarn comprising:

melt spinning at least two filaments of a fiber forming polymer directly without winding to a suffusion coating apparatus;

continuously suffusing electrically conductive particles uniformly in an annular region at the periphery of each filament such that after said suffusing each filament is electrically conducting thereby creating a multifilament conductive yarn; and winding the resulting multifilament yarn.

14. The process of claim 13 wherein the conductive particles are carbon black.

15. The process of claim 13 wherein the filaments have residual heat from said melt spinning during said suffusing.

16. The process of claim 13 wherein said suffusing is with a grooved applicator.

17. The process of claim 16 wherein the applicator has one groove for each filament.

18. The process of claim 13 further comprising drawing the fiber prior to said suffusing.

19. A process for preparing multifilament conductive yarn comprising:

melt spinning at least two filaments of a fiber forming polymer directly without winding to a suffusion coating apparatus;

continuously suffusing electrically conductive particles uniformly in an annular region at the periphery of each filament; such that after said suffusing each filament is electrically conducting thereby creating a multifilament conductive yarn;

winding the resulting multifilament yarn; and subjecting at least some filaments to a source of latent non-symmetrical stress prior to said suffusing.

20. The process of claim 19 wherein the source is a knife edge.

* * * * *

UNITED STATES PATENT AND TRADEMARK OFFICE

CERTIFICATE OF CORRECTION

PATENT NO. : 5,308,563

DATED : May 3, 1994

INVENTOR(S) : John A. Hodan; Otto M. Ilg; Melvin R. Thompson; Donald B. Thompson It is certified that error appears in the above-identified patent and that said Letters Patent is hereby corrected as shown below:

At column 9, line 9, please insert —in an— after "uniformly" and before "annular".

Signed and Sealed this

Ninth Day of August, 1994

Bruce Lehman

*Attest:*

BRUCE LEHMAN

*Attesting Officer*

*Commissioner of Patents and Trademarks*